United States Patent [19]

Florian

[11] 4,058,247

[45] Nov. 15, 1977

[54] COMMODITY PACKAGING TRAY

[75] Inventor: John Florian, Bakersfield, Calif.

[73] Assignee: Mobil Oil Corporation, New York, N.Y.

[21] Appl. No.: 741,913

[22] Filed: Nov. 15, 1976

[51] Int. Cl.[2] ..... B65D 1/34

[52] U.S. Cl. ..... 229/2.5 R; 229/29 M; 220/DIG. 14

[58] Field of Search ..... 229/2.5, 29 M; D9/219; 220/72, DIG. 14

[56] References Cited

U.S. PATENT DOCUMENTS

| | | | |
|---|---|---|---|
| 2,296,808 | 9/1942 | Chaplin | 229/2.5 R |
| 2,843,304 | 7/1958 | Reifers | 229/29 M |
| 2,873,782 | 2/1959 | Gunn | 220/DIG. 14 |
| 2,975,931 | 3/1961 | Harrison | 229/2.5 X |
| 3,215,326 | 11/1965 | Despres | 229/29 M X |
| 3,494,723 | 1/1976 | Walker | 229/2.5 R |
| 3,578,204 | 5/1971 | Bloch | 229/2.5 R |
| 3,929,564 | 12/1975 | Reifers | 229/2.5 R X |
| 3,956,550 | 5/1976 | Sutch | 229/2.5 R X |

*Primary Examiner*—Davis T. Moorhead
*Attorney, Agent, or Firm*—Charles A. Huggett; Ronald J. Cier

[57] ABSTRACT

A rectangularly shaped tray comprising a bottom product-supporting wall and up-standing side and end walls. The bottom product supporting wall is characterized by being elevated at its center portion, such as is provided by a quadrilateral pyramid-like bottom product-supporting wall with the apex of said quadrilateral pyramid being at the center portion of the bottom wall and at an elevation higher than the horizontal plane of the bottom of the four corners of said tray, whereby, when the commodity to be packaged is placed in the tray, the weight of said commodity presses the bottom wall of the tray downwardly resulting in the longer sidewalls of the tray being pulled inwardly. In one embodiment, each of the longer sidewalls is further characterized by having a horizontal rib disposed in its upper portion for stiffening purposes to prevent undesired bow-out of the sidewalls and each of the corners, formed by adjacent intersecting walls, comprises a reverse-radius step portion that strengthens said corners to inhibit cracking.

8 Claims, 7 Drawing Figures

Fig.1
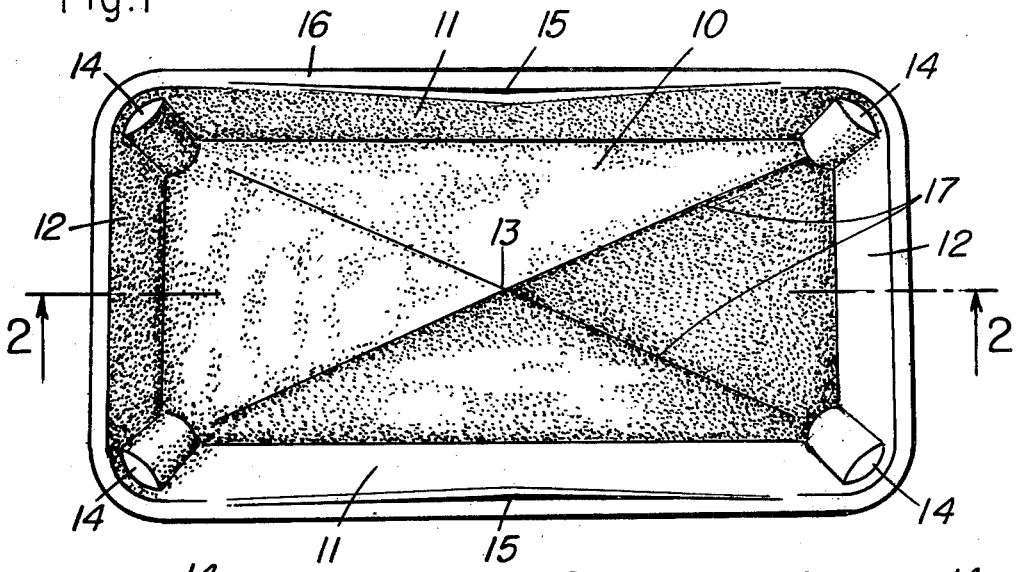
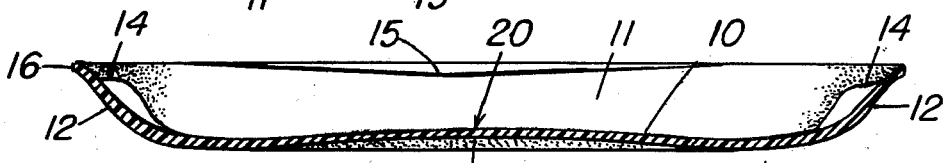
Fig.2
Fig.4
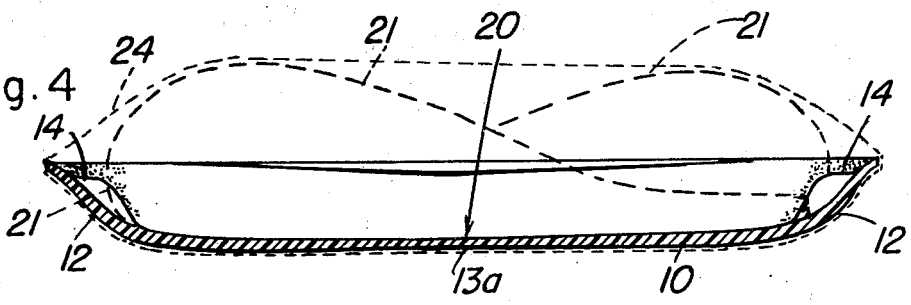
Fig.3
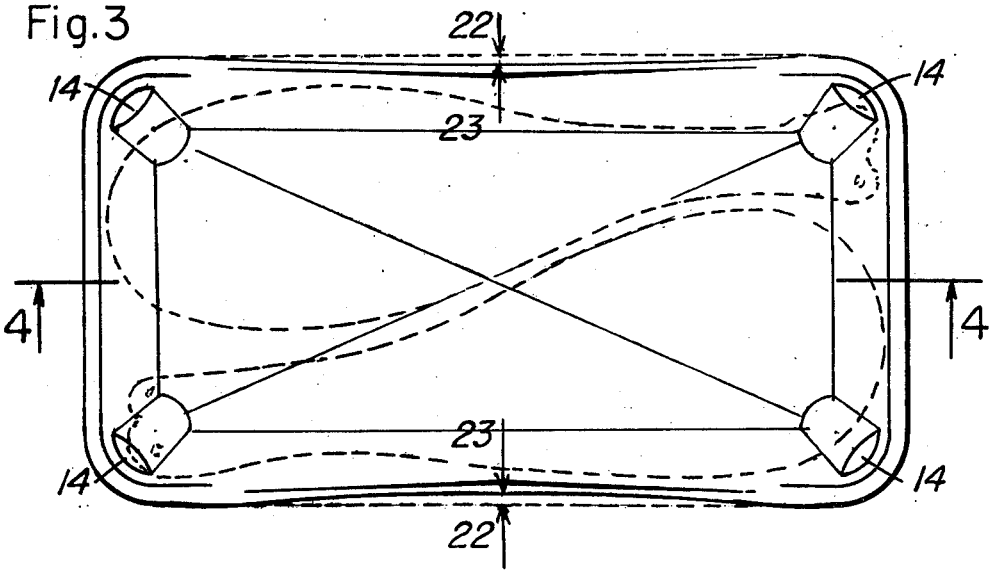

COMMODITY PACKAGING TRAY

BACKGROUND OF THE INVENTION

1. Field of the Invention

The present invention relates to packaging support trays useful in the retailing of pre-packaged meat, fish, poultry, fresh produce and the like.

2. Description of the Prior Art

For the most part, support trays used in the pre-packaging of edible products for the retail trade are generally characterized by having a relatively flat product-supporting bottom wall and upstanding end and side walls that flare outwardly from the bottom wall. A commodity, such as an individual portion of meat as one might encounter in a retail food market, is placed in the tray and the tray overwrapped, such as with a clear plastic film, so that a prospective consumer might inspect the commodity without handling and contaminating it. In certain instances, trays of the prior art teachings have several shortcomings. One such shortcoming lies in the integrity of the tray after it has been overwrapped. If the sidewalls of the tray are not at the proper angle to the film during the wrapping operation, the overwrapping film will tend to exert a downward and outward force on the upper edge of said sidewalls as it is brought into contact with the tray, the result being the propagation of cracks and tears in the sidewalls. Such cracks and tears not only compromise the purpose of the tray (i.e., the safe, clean and sanitary packaging of food), but also are unsightly and costly in terms of the manpower and materials needed to repackage the contents of the damaged tray. Another shortcoming lies in the straightness of the longer sidewalls, especially in rectangularly shaped trays which are relatively large or are very much longer then they are wide. With trays which are relatively deep, it is important that the sides of the tray remain as upstanding as possible, i.e., that they do not "bow-out" at the center. Such bow-out commonly causes problems with the overwrapping operation, as well as product retention, and detracts from the desired pleasing appearance of the tray. Still another shortcoming with certain prior art trays is that they have a tendency to crack at the corners, especially when they are handled roughly as is common in the refrigerated cases of retail food markets. Such cracking is undesirable as liquids retained by the tray tend to leak out and compromise the sanitary condition of the food inside the tray.

SUMMARY OF THE INVENTION

The present invention is directed to a tray, preferably of thermoformed polystyrene foam, that is generally rectangular in shape, comprising a bottom product-supporting wall and integral up-standing end and sidewalls. The bottom wall of the tray is elevated at its center, preferably such as that resulting from a quadrilateral pyramid-like shape having the corners of its base in correspondence with the corners of said bottom wall such that, when the product to be packaged is placed in the tray, its weight presses down on the raised center portion of the bottom wall and depresses such raised portion which in turn pulls both long sidewalls slightly inwardly. This is important in the film wrapping operation as the inwardly pulled sidewalls, in assuming a more upright position when the upstanding sidewalls are originally flared outwardly, become set into a more appropriate angle with the overwrapping film whereby the film will desirably pull the sidewalls inwardly against the product. Thus, the sidewalls are inhibited against bending outwardly as a result of the pull exerted by the overwrapping film, thereby preserving the integrity of the tray.

In one embodiment, the rectangular tray of the present invention has a horizontal rib in each of the longer sidewalls and, preferably, at the upper portion of the sidewalls. Such a rib structure aids in maintaining said longer sidewalls in a straightened condition to prevent the undesirable bow-out discussed hereinbefore.

In further embodiment, the tray structure embodied herein contains means for strengthening its corners to decrease cracking tendencies. In that regard, the tray corners are formed so as to protrude inwardly as a curved inward projection which extends upwardly, but short of the top of the tray walls, at each of the lines of intersection of the corner-forming adjacent sidewalls.

BRIEF DESCRIPTION OF THE DRAWINGS

FIG. 1 is a top view of a tray according to the present invention;

FIG. 2 is a section taken along line 2—2 of FIG. 1 showing the elevation of the center of the bottom surface;

FIG. 3 is a top view as in FIG. 1 illustrating the inward movement of the long sidewalls resulting from a weight, such as the packaged commodity, pressing on the bottom wall surface of the tray;

FIG. 4 is a section, taken along line 4—4 of the overwrapped tray of FIG. 3.

DESCRIPTION OF PREFERRED EMBODIMENTS

Figure 5:
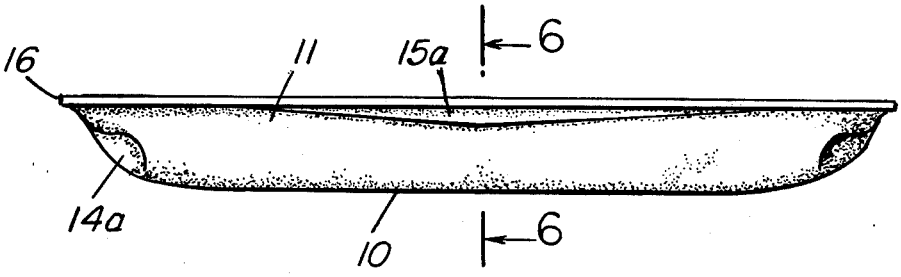
FIG. 5 is a side elevation of a tray as embodied herein showing the long side wall thereof.
Figure 6:
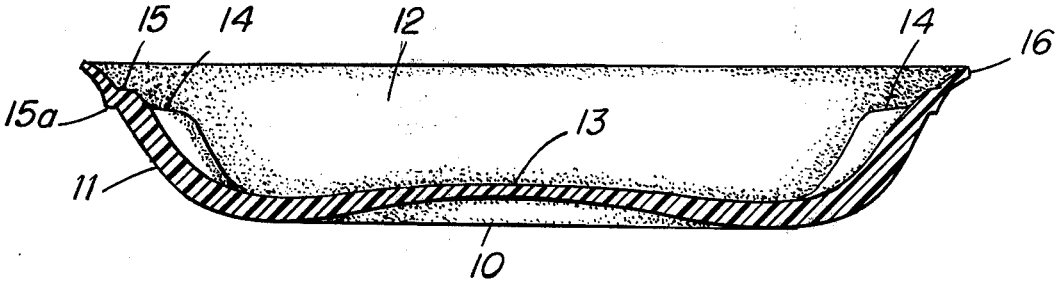
FIG. 6 is a section taken along line 6—6 of FIG. 5 showing the elevated center portion of the bottom surface.

The following description of preferred embodiments relate to a rectangular tray, adapted for packaging edible products such as poultry, thermoformed from a sheet of polystyrene foam having a thickness of 100 mils and a density of 0.08 gm/cc.

In particular, and with reference to FIG. 1 of the drawings, the tray comprises a bottom product-supporting wall 10 which is relatively thinner at the center portion than at the edges and integral upstanding outwardly flared sidewalls 11 and endwalls 12, sidewalls 11 being relatively longer than endwalls 12. Bottom 10 is elevated at its center portion 13, said center being characterized by the intersection of integrally formed diagonal creases 17 which pass from each corner of said bottom wall 10 to each diagonally opposed corner of said surface, resulting in a generally quadrilateral pyramide-like shape. In the tray embodiment constructed from polystyrene foam described above, the bottom wall 10 is 24 cm long by 11 cm wide and walls 11 and 12 were flared outwardly at an angle of approximately 30° from bottom wall 10 and 2.85 cm in height. Center portion 13 is at an elevation 0.63 cm. above the horizontal plane formed by the bottoms of the four corners of the tray.

The corners of the tray, i.e., the lines of intersection of sidewalls 11 with adjacent endwalls 12, protrude inwardly in a curved fashion to form reverse radius steps 14 which extend upwardly from bottom wall 10 but short of lip 16, which lip forms a continuous edge around the upper portion of said walls. In this specific embodiment, said steps 14 are characterized by an arc of approximately 1.9 radians protruding 0.63 cm into the tray and extending upwardly approximately 1.9 cm.

The upper portion of each sidewall 11 has a horizontal rib 15 integrally formed therein that reinforces said sidewall 11 and aids in maintaining a substantially straight profile.

Figure 7:
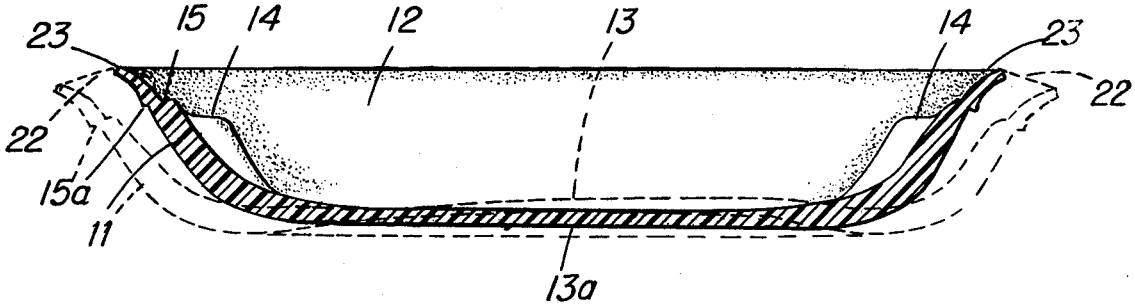
FIG. 7 is the section of FIG. 6 showing the inward movement of the long sidewalls resulting from flattening the bottom surface of the tray.

Utilization of the tray structure of this invention is exemplified with reference to FIGS. 2 through 7, wherein FIGS. 3 and 4 show a turkey leg in outline form contained within such a tray and overwrapped with a transparent plastic film of, for example, polyvinylchloride (PVC). FIG. 2 is a cross section of the tray taken along line 2—2 of FIG. 1 and shows the elevated center 13 of bottom 10. When a force is applied directed along arrow 20, as represented by the weight of turkey legs 21 in FIG. 4, bottom wall 10 flattens out by depression of elevated center 13 to the substantially flat plane position 13*a*, and each of the sidewalls 11 are moved inwardly, as shown in FIGS. 3 and 7, such that the upper edges thereof move from position 22 (shown in dotted outline) to position 23 (shown in solid outline). Such movement of the center of sidewalls 11 in a tray of the dimensions hereinbefore described is approximately 3.1 mm. toward the vertical as measured at lip 16.

The tray, containing the turkey legs as shown in FIGS. 3 and 4 and having sidewalls 11 flexed slightly inwardly to position 23, is then in improved condition to be overwrapped with wrapping 24 by appropriate and conventional wrapping means. Wrapping 24, upon being applied to such inwardly flexed sidewalls, will exert its force in a generally downward and inward direction thereto, thereby holding sidewalls 11 in inwardly flexed position 23 and avoiding the prior art situation wherein the sidewalls were torn during the overwrapping process.

The tray structure of this invention may be constructed of any material, possessing appropriate flexibility characteristics, such as is normally used in the construction of packaging trays for edible commodities, such as paper pulp and plastic materials. Preferred is a thermoformed plastic tray, as embodied herein, made from polystyrene foam.

It will be recognized that numerous variations may be made in a tray constructed in the manner of this disclosure by one skilled in the art without departing from the spirit and scope of the invention as described herein.

What is claimed is:

1. A tray of substantially rectangular shape adapted for packaging of an edible product, said tray comprising: a bottom product-supporting wall and integral side walls upstanding from said bottom wall; said side walls including two oppositely disposed longer side walls; said bottom wall being elevated at its center portion to above the horizontal plane described by the bottoms of the four corners of said tray; said bottom product-supporting wall being depressible to said horizontal plane described by the bottoms of said four corners of said tray when said product is placed on said elevated center portion of the product-supporting wall; and each of said two longer side walls being flexible inwardly upon depression of said bottom product-supporting wall.

2. A tray, as defined in claim 1, wherein said bottom wall has the shape of a quadrilateral pyramid with its apex at substantially the center portion of said bottom wall and with said apex being at an elevation above the horizontal plane described by the bottoms of the corners of said tray.

3. A tray, as defined in claim 2, wherein said bottom wall is relatively thinner at said elevated center portion than the outer edges thereof.

4. A tray, as defined in claim 3, further comprising a substantially horizontal rib in the upper portion of each of the two longer upstanding sidewalls.

5. A tray, as defined in claim 4, further comprising a curved, inward projection at each of the four corners of said tray.

6. A tray, as defined in claim 5, made of thermoformed polystyrene foam.

7. A tray, as defined in claim 1, constructed of polystyrene foam plastic.

8. A tray, as defined in claim 1, containing a packaged commodity and overwrapped with a transparent plastic film.

* * * * *